United States Patent [19]

Solomon

[11] Patent Number: 5,029,719

[45] Date of Patent: Jul. 9, 1991

[54] BOTTLE AND CAP ASSEMBLY

[76] Inventor: Stanley B. Solomon, 29 Misty Acres Rd., Rolling Hills Estates, Calif. 90274

[21] Appl. No.: 514,862

[22] Filed: Apr. 26, 1990

Related U.S. Application Data

[63] Continuation-in-part of Ser. No. 472,651, Jan. 30, 1990, Pat. No. 4,976,364, and a continuation-in-part of Ser. No. 378,802, Jul. 11, 1989.

[51] Int. Cl.[5] ..... B65D 47/14

[52] U.S. Cl. ..... 215/229; 215/1 A; 215/309; 220/254; 220/90.2; 220/90.4

[58] Field of Search ..... 215/229, 1 A, 228, 306, 215/309; 220/254, 256, 355, 356, 361, 90.2

[56] References Cited

U.S. PATENT DOCUMENTS

| | | | |
|---|---|---|---|
| D. 285,186 | 8/1986 | Sinyard . | |
| 2,110,026 | 3/1938 | Rose | 215/309 X |
| 2,617,559 | 11/1952 | Van Der Spek | 215/1 A |
| 2,724,536 | 11/1955 | Pugh, Sr. | 215/1 A |
| 2,815,879 | 3/1955 | Hermes . | |
| 2,839,229 | 6/1958 | Scheswohl | 220/254 X |
| 3,071,303 | 1/1963 | Pugh . | |
| 3,173,566 | 3/1965 | Talbert . | |
| 3,215,329 | 11/1965 | Pugh, Sr. . | |
| 3,220,587 | 11/1965 | Griffin et al. . | |
| 3,325,076 | 8/1965 | Soucy . | |
| 3,425,626 | 2/1969 | Dietz et al. . | |
| 3,480,172 | 11/1969 | Shine | 215/309 X |
| 3,606,156 | 9/1971 | Homorodean, Jr. et al. . | |
| 3,623,632 | 11/1971 | Chang . | |
| 3,655,102 | 4/1972 | Moran | 215/309 X |
| 3,776,458 | 12/1973 | Chunga, Sr. . | |
| 3,792,798 | 2/1974 | Chang . | |
| 3,840,153 | 10/1974 | Devlin . | |
| 3,851,441 | 12/1974 | Marchand . | |
| 3,874,554 | 4/1975 | Chang . | |
| 4,090,650 | 5/1978 | Gotta . | |
| 4,095,812 | 6/1978 | Rowe . | |
| 4,134,247 | 1/1979 | Sather . | |
| 4,226,356 | 10/1980 | Lemelson . | |
| 4,251,019 | 2/1981 | Cone . | |
| 4,265,363 | 5/1981 | Conn . | |
| 4,441,640 | 4/1984 | Lottick | 220/90.2 X |
| 4,448,316 | 5/1984 | Hiroshige . | |
| 4,485,963 | 12/1984 | Panicci . | |
| 4,709,829 | 12/1987 | Johnson et al. . | |
| 4,798,301 | 1/1989 | Bullock et al. . | |
| 4,828,128 | 5/1989 | Tackles . | |
| 4,830,239 | 5/1989 | Tackles et al. . | |
| 4,830,240 | 5/1989 | Tackles et al. . | |
| 4,848,622 | 7/1989 | Kroetsch . | |
| 4,911,315 | 3/1990 | Shrum | 220/90.2 X |
| 4,925,040 | 5/1990 | Wang | 220/90.2 X |

*Primary Examiner*—Stephen Marcus
*Assistant Examiner*—Vanessa M. Roberts
*Attorney, Agent, or Firm*—Kelly Bauersfeld & Lowry

[57] ABSTRACT

An improved cap assembly is provided for use with a water bottle or the like. The cap assembly includes a lid member adapted to fit over the open mouth of the bottle, and to support a drinking straw which extends from the lid member to a lower end substantially adjacent to a bottom wall of the bottle. An apertured cylindrical stem is carried by the lid member and may include a poppet valve or the like to selectively permit delivery of the bottle contents through the straw and stem to the exterior of the bottle. A protective closure cap fits removably over the apertured stem in sealing relation therewith to prevent leakage of the bottle contents.

8 Claims, 2 Drawing Sheets

BOTTLE AND CAP ASSEMBLY

This application is a continuation-in-part of copending U.S. Ser. No. 472,651, filed Jan. 30, 1990, now U.S. Pat. No. 4,976,364, issued Dec. 11, 1990. In addition, this application is a continuation-in-part of copending U.S. Ser. No. 378,802, filed July 11, 1989.

BACKGROUND OF THE INVENTION

This invention relates generally to improvements in water bottles of the type used to carry a supply of drinking water or other selected beverage. More particularly, the present invention relates to improvements in cap and valve structures for selectively controlling dispensing of the bottle contents.

Small water bottles, canteens, etc., are well known in the art for storing and carrying a supply of drinking water or other selected beverage in a manner adapted for easy portability and immediate dispensing. Such containers are useful in many different environments to provide a convenient source of drinking water or other preferred beverage which otherwise may not be readily available. By way of example, such compact water bottles have become popular with bicyclists, wherein such water bottles can be mounted onto the frame of a bicycle. Similarly, compact water bottles are widely used by hikers, joggers, and other persons in the course of many different recreational, athletic, and/or outdoor activities.

In one common form, the water bottle comprises a compact bottle body having an upper neck defining a relatively wide mouth to permit filling with drinking water or the like. The bottle neck is adapted to receive a removable cap or lid which is often equipped with a poppet valve. The lid normally closes the bottle mouth, with the accompanying poppet valve being movable between open and closed positions for respectively permitting or preventing beverage dispensing. In this regard, a standard or typical poppet valve known in the art comprises an upright cylindrical body formed integrally with and extending through the bottle cap to define an outlet port, in combination with a reciprocal valve member therein to open and close the outlet port. Beverage dispensing is normally accomplished by inverting and draining the bottle contents. Alternatively, with a plastic bottle formed from a lightweight and deformable plastic material, the beverage can be partially dispensed by squeezing the bottle body to force the contents upwardly through the poppet valve.

Unfortunately, in some environments of use, bottle inversion for dispensing purposes can be undesirable. As one example, a bicyclist or jogger must divert his attention from the road at least momentarily in order to drink from an inverted bottle. Similarly, bottle inversion with its inherent requirement of bottle elevation can be especially undesirable in military combat situations. The use of a squeeze type bottle does not satisfactorily remove the disadvantages associated with bottle inversion, since a squeeze bottle still requires inversion for dispensing unless the bottle is in a substantially full condition.

In the past, many beverage containers have been proposed to include a drinking straw which can be used for beverage dispensing without requiring container inversion. In some instances, the drinking straw is integrated with disposable container packaging for insertion into the container when opened. In other cases, the drinking straw is preinstalled loosely within the container for access and use when the container is opened. In still other designs, the poppet valve structure includes a drinking straw which extends downwardly into the bottle to a position spaced slightly above a bottom wall of the bottle, as shown and described in the above-referenced Ser. No. 472,651.

The present invention is directed to further improvements in a cap and straw assembly for a water bottle, particularly for use with squeezable or rigid bottles and wherein substantially the entire contents of the bottle may be dispensed without requiring bottle inversion.

SUMMARY OF THE INVENTION

In accordance with the invention, an improved cap assembly is provided for use with a water bottle of the type adapted for storing and carrying a small supply of drinking water or other selected beverage. The improved cap assembly includes a drinking straw which extends to a bottom wall of the bottle and includes cutouts defining water entry ports at a lower end thereof, such that substantially the entire contents of the water bottle can be dispensed without requiring bottle inversion.

In the preferred form, the cap assembly is designed for use with a water bottle having a compact bottle body with an upper neck defining a relatively wide or open mouth. The cap assembly includes a lid member adapted to mount onto the bottle neck in a position closing the mouth. The drinking straw has an upper end supported at the underside of the lid member in a position surrounding a lower end of an apertured stem carried by the lid member. The straw extends downwardly from the lid member to a position abutting or nearly abutting the bottom wall of the bottle body. The contents of the bottle can be drawn by sucking through the straw and further through the apertured stem, without requiring bottle inversion. Alternately, when the bottle body is formed from a resiliently deformable material, the contents may be dispensed by squeezing the bottle.

A protective closure cap fits removably over the apertured lid member to provide a fluid tight seal therewith. In one form, the closure cap includes a depending valve member positioned to seat within a valve port formed in the stem. In another form, the stem may include a movable poppet valve adapted to open and close the stem valve port, in which case the closure cap is configured to fit over and seat with the stem and poppet valve. In either case, the closure cap is shaped for mating fit with substantially zero clearance with the stem and/or poppet valve in the vicinity of the valve port.

In accordance with further aspects of the invention, the lid member will normally include a vent hole when used in combination with a rigid or nonsqueezable bottle body to permit air entry into the bottle when the contents are drawn by suction through the straw. The closure cap conveniently includes an enlarged shoulder segment having a size and shape to fit over and to substantially seal the vent hole when the cap is mounted onto the lid member.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
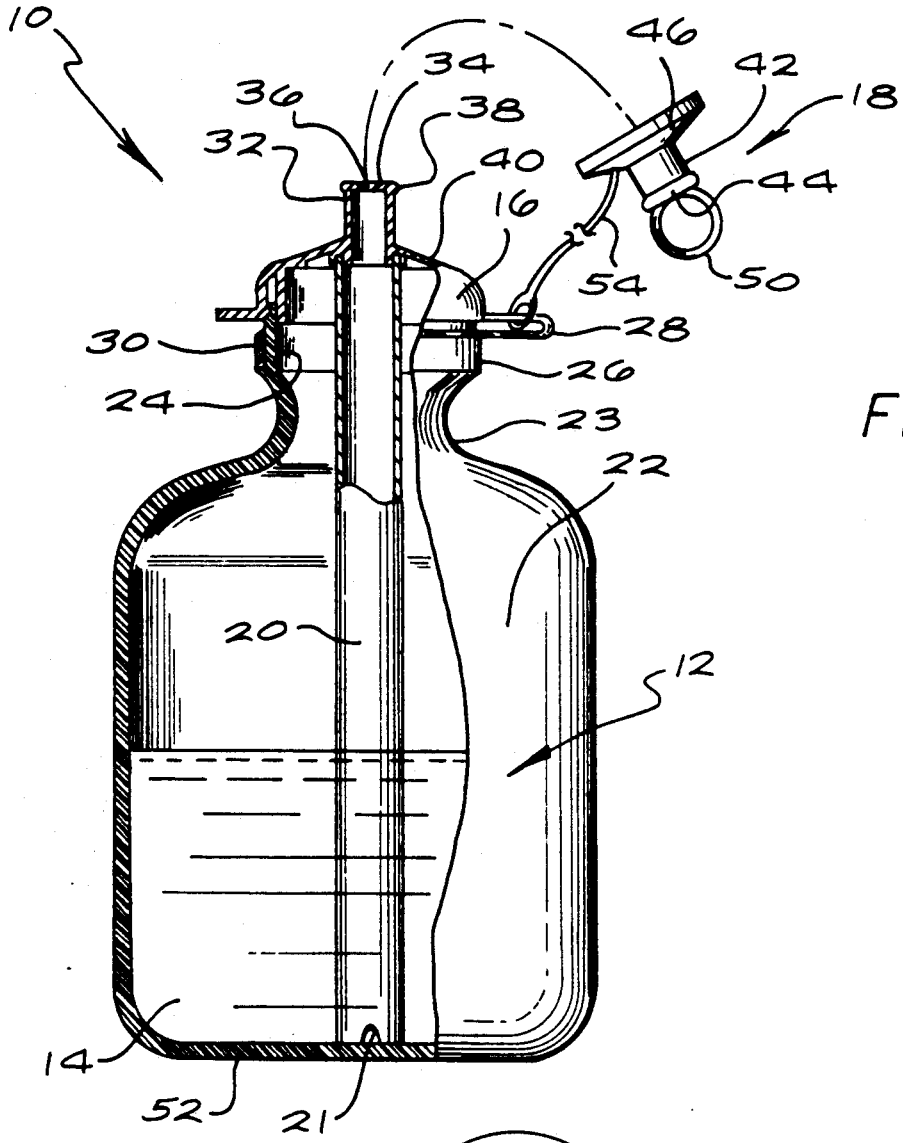
FIG. 1 is a partially fragmented side elevational view illustrating a water bottle equipped with an improved cap assembly embodying the novel features of the present invention.
Figure 2:
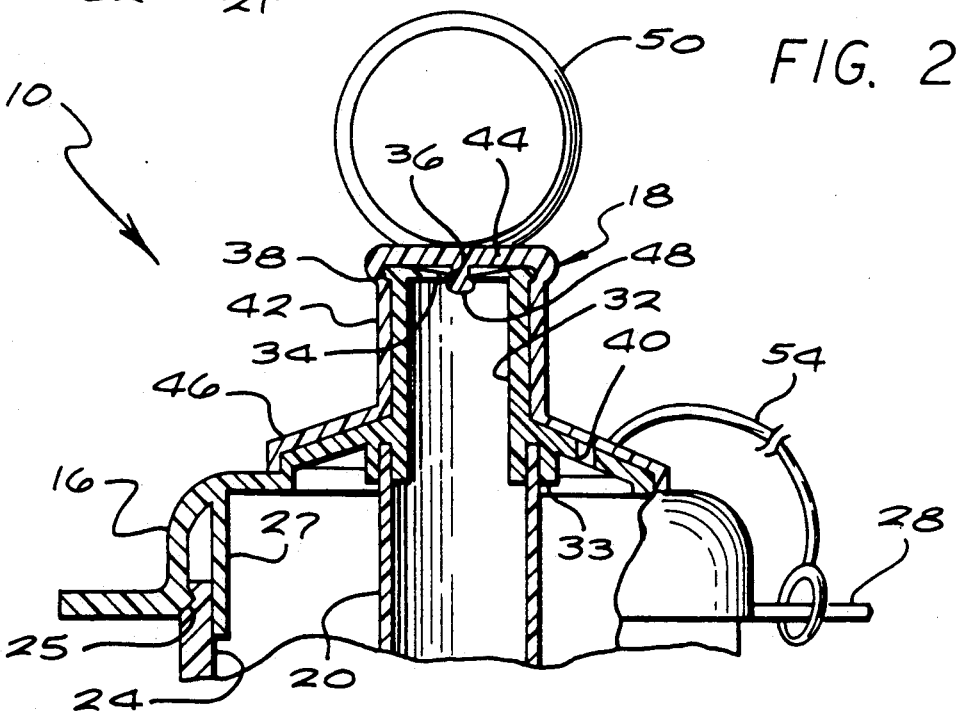
FIG. 2 is an enlarged fragmented elevational view of the top of the water bottle depicted in FIG. 1, but illustrating a closure cap in a closed and sealed position.

As shown in the exemplary drawings, an improved cap assembly referred to generally in FIGS. 1 and 2 by the reference numeral 10 is provided for use with a bottle 12 of the type adapted for receiving and carrying a supply of drinking water 14 or other selected beverage. The cap assembly 10 includes an apertured lid member 16 supporting a drinking straw 20 and a protective closure cap 18 which fits over and closes a valve port formed in the lid member 16. The drinking straw 20 permits the bottle contents to be dispensed substantially completely without requiring bottle inversion.

The overall construction of the illustrative water bottle 12 is generally known in the art to include a lower bottle body 22 formed typically from a lightweight molded plastic to have a selected size and shape. The bottle body 22 defines an upper neck 23 forming a relatively wide or open mouth 24 which is normally covered and closed by the lid member 16. In this regard, FIGS. 1 and 2 depict a lightweight lid member 16 of molded plastic material similar to the bottle body construction and having an internal snap rib 25 for snap-fit mounting onto the bottle neck 23 in a removable manner. The lid member 16 may also include an annular flange 27 which seats within the bottle neck 23 for a more positive fit. A support ring 26 may be attached to the lid member 16 by a flexible web 28, with the support ring being adapted for seated reception within an external channel 30 formed about the bottle neck 23 to prevent inadvertent separation of the lid member 16 from the bottle. Alternately, it will be understood that other cap configurations may be used, such as thread-on caps, etc. Moreover it will be understood that the specific bottle shape and material may vary widely, with a rigid plastic or metal canteen structure being shown in FIGS. 1 and 2, and with a deformable or squeezable plastic bottle 12' being depicted in FIG. 3.

In accordance with the improvements provided by the present invention, the lid member 16 is adapted to receive and support the drinking straw 20, such that the lid member 16 and straw 20 cooperatively accommodate water dispensing without requiring bottle inversion. In the preferred form, the lid member 16 includes a hollow stem 32 which extends upwardly from the lid member a sufficient distance to accommodate the mouth of a person drinking from the bottle 12. The stem 32 also protrudes downwardly a short distance from the lid member 16 to be circumscribed by the upper end of the straw 20. An annular support flange 33, coaxial with the stem 32, also extends downwardly from the lid member 16 to circumscribe the upper end of the straw 20, such that the drinking straw 20 may be press-fit between the stem 3 and annular flange 33 for secure anchoring of the straw 20. If desired, the relative lengths of the stem and flange may be extended downwardly for better press-fit engagement with the straw, or the upper end of the straw may include short slits (not shown) therein for facilitated press-fit engagement with the stem and flange.

The lower end of the drinking straw 20 is positioned substantially against the bottom end wall 52 of the bottle body, as shown in FIG. 1. Importantly, this lower end of the straw includes small cutouts 21 defining water entry ports placing the interior of the straw in flow communication with the interior of the bottle body. Accordingly, sucking action applied to the straw 20 pulls the water upwardly through the straw 20 and further through the stem 32, thereby permitting dispensing of substantially the entire bottle contents without bottle inversion. Such dispensing is extremely advantageous, for example, in many environments of use, such as in a military combat situation.

The upper end of the stem 32 defines an end wall 34 having a small central opening 36 defining an exit port. As shown in FIG. 2, the thickness of the end wall 34 diminishes in a direction toward the central opening 36, such that the end wall 34 is relatively flexible around the central opening. The lid member 16 also includes a small vent hole 40 in one of its surfaces to permit air entry into the bottle when the contents are drawn through the straw.

The protective closure cap 18 fits over the lid member 16 to prevent fluid from leaking from the bottle 12. The closure cap 18 includes a cylindrical portion 42 having an internal geometry to fit matingly over the stem 32, preferably with a snap-fit reception of a slightly enlarged annular flange 38 at the uppermost end of the stem 32. An upper end wall 44 of the closure cap 18 overlies the stem end wall 34 to close the port 36 therein, with a bulbular valve member 48 desirably protruding from the wall 44 for snap-fit reception through the port 36 in the closed position. The cylindrical portion 42 of the closure cap merges with a shoulder segment 46 which extends matingly over the exterior of the lid member 16 to cover and overlie the vent hole 40. A pull ring 50 at the top of the closure cap is provided to facilitate removal from and mounting onto the lid member 16, and a flexible tether 54 interconnects the cap shoulder segment 46 with the flexible web 28 to prevent separation and/or loss of the cap.

Figure 3:
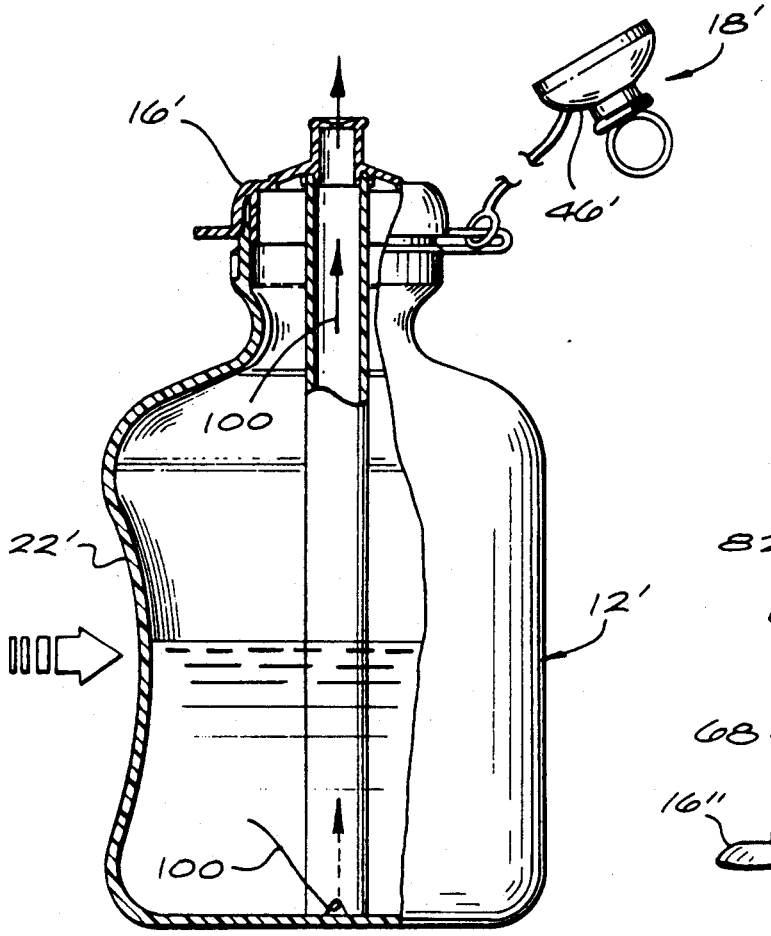
FIG. 3 is a partially fragmented side elevational view similar to FIG. 1, but depicting a squeezable water bottle equipped with the improved cap assembly.

The improved cap assembly 10 of the present invention may alternatively be used with a squeezable water bottle 12' having a lightweight bottle body 22' of molded plastic or the like, as viewed in FIG. 3. In this regard, the lid member 16 and associated closure cap 18 as previously described with respect to FIGS. 1 and 2 may be used. With a squeezable bottle body, substantially the entire contents of the bottle can be dispensed by reducing the volume of the bottle body and thereby expressing the contents upwardly through the straw and associated stem of the lid member, as illustrated by arrows 100. However, in this version, air entry into the bottle can occur through the stem and straw after squeeze dispensing, such that a modified lid member 16' omitting the vent hole 40 (FIG. 2) may be used. Moreover, the absence of the vent hole permits use of an alternative closure cap 18' having a more decorative shoulder segment 46' of dome shape or the like.

Figure 5:
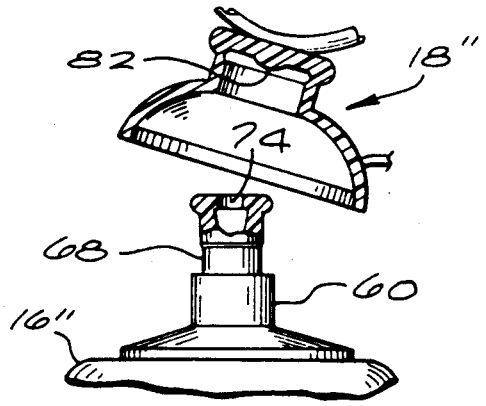
FIG. 5 is an exploded fragmented view similar to FIG. 4, but showing a closure cap removed from the underlying cap assembly component.
Figure 4:
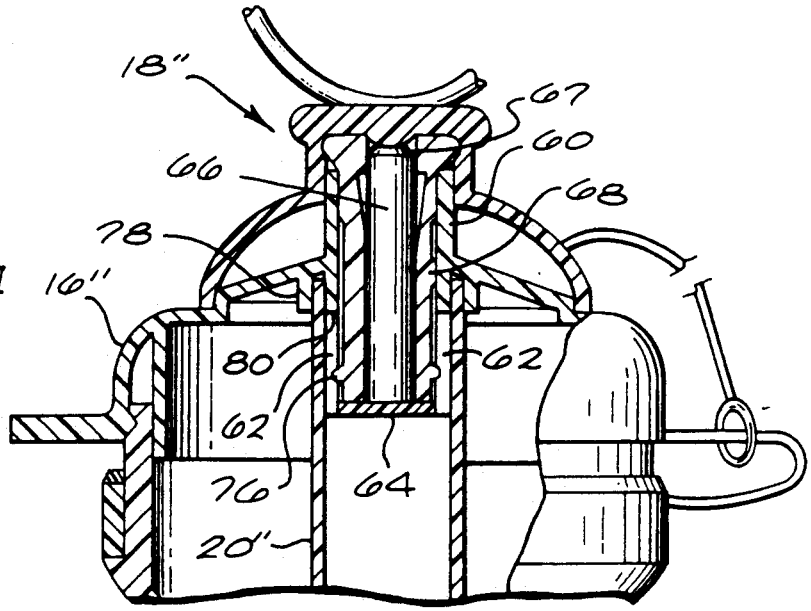
FIG. 4 is an enlarged fragmented side elevational view similar to FIG. 2, but illustrating an alternative preferred form of the invention.

FIGS. 4 and 5 illustrate the improved cap assembly of the present invention in connection with a poppet valve at the top of the water bottle, wherein the water bottle may have a rigid or squeezable construction. In this version, the poppet valve is centrally mounted on a modified lid member 16" in a position extending along a central vertical cap axis and comprises a generally cylindrical and hollow valve stem 60 which is preferably formed integrally with the lid member 16" to extend upwardly at least a short distance therefrom. Beneath the lid member 16", the cylindrical valve stem 60 merges with a circumferentially spaced plurality of support legs 62 which protrude downwardly from the lid member in parallel relation to each other and substantially in the form of continuations of the valve stem structure. The lowermost ends of these support legs 62 are joined in turn to a generally circular valve seat disk 64. The valve seat disk 64 is thus spaced below the underside of the lid member 16", with the spacing between the support legs 62 cooperating with the interior of the valve stem 60 to define an exit passage for water or the like within the bottle.

The poppet valve further includes a valve guide post 66 mounted within the valve stem 60 to extend generally along the central axis. This guide post 66 is supported by and upstands from the valve seat disk 64 and terminates at an upper flat blunt tip 67 disposed at least slightly above the uppermost margin of the valve stem 60. A cylindrical poppet sleeve 68 of molded plastic or the like fits snugly into the valve stem 60 for vertical reciprocatory motion along the post 66 to open and close the poppet valve to water flow.

More particularly, the poppet sleeve 68 defines an internal bore sized for relatively free sliding motion about the guide post 66, and an external diameter sized for relatively snug yet sliding fit into the valve stem 60. An axially lower end of the poppet sleeve 68 is adapted to seat upon the valve seat disk 64 when the poppet sleeve is pushed downwardly into the valve body toward a lower position (FIG. 4). In this lower position, the poppet sleeve 68 substantially closes the valve by blocking fluid flow between the support legs 62 to the interior of the valve stem 60. The effectiveness of this sealing action is enhanced by forming a radially enlarged flange at the upper end of the poppet sleeve to seat onto the upper end of the valve stem. In addition, a slightly enlarged upper sleeve region of the poppet sleeve may be formed for press-fit into the valve stem, and an exit port 74 in the upper end of the poppet sleeve fits snugly over the blunt upper end tip 67 of the guide post.

The poppet valve is opened by lifting the poppet sleeve 68 within the valve stem 60. In this upper or open position (FIG. 5), the lower end of the sleeve 68 is spaced above the valve seat disk 64 to permit fluid to flow between the support legs 62 and upwardly through the poppet sleeve 68 by virtue of the substantial clearance between the poppet sleeve and the valve guide post 66. This fluid flow may continue through the exit port 74 in the poppet sleeve. Conveniently, detent tabs 76 near the lower end of the poppet sleeve 68 engage the underside of the lid member 16" for normally preventing poppet sleeve removal from the lid member. In this regard, the overall construction and operation of the poppet valve components conforms generally with the disclosure of copending Ser. No. 472,651, which is incorporated by reference herein.

In accordance with the improvements provided by the present invention, the lid member 16" is adapted to receive and support a drinking straw 20", such that the poppet valve and straw 20" cooperatively accommodate water dispensing without requiring bottle inversion. In the preferred form, the lid member includes at least one and preferably two depending annular flanges 78 and 80 which concentrically enclose or circumscribe the lower end of the poppet valve at the underside of the lid member 16". Internal annular flange 80 may be formed as a short continuation of the valve stem 60 for press-fit engagement into the upper end of the drinking straw 20". The outer annular flange 78 would be formed concentrically about the inner flange 80, such that the drinking straw may be press-fit between these flanges 78 and 80 for secure anchoring. Alternately, if desired the drinking straw 20" may be anchored by other means, such as by an appropriate adhesive or the like.

In use, when the poppet valve is opened by upward displacement of the poppet sleeve 68, a person may draw the contents of the bottle through the drinking straw 20" and further through the poppet valve by sucking in the manner of a conventional drinking straw. The upwardly protruding valve stem 60 is conveniently exposed above the lid member 16" and thus provides an effective continuation of the straw 20" for easy access to the person drinking from the bottle. With the lower end of the drinking straw abutting the bottom end wall of the bottle body, the entire contents of the bottle can be dispensed without bottle inversion, either by sucking action on the poppet sleeve or by simply squeezing the bottle body.

A protective closure cap 18" for the improved cap assembly of FIGS. 4–5 is substantially identical to the protective cap 18' of FIG. 3, except that the interior geometry of the cap includes a central flat blunt projection 82 adapted to engage the blunt tip 67 of the guide post 66. Alternately, for use with a nonsqueezable bottle, the closure cap may be constructed according to FIGS. 1 and 2, but to include the blunt projection 82 to engage the post tip 67.

A variety of further modifications and improvements to the present invention will be apparent to those skilled in the art. Accordingly, no limitation on the invention is intended by way of the foregoing description and accompanying drawings, except as set forth in the appended claims.

What is claimed is:

1. A protective cap for use in combination with a bottle having a bottle body defining an open mouth for receiving a selected beverage into the interior thereof, a lid member defining an upper side and a lower side, and a generally cylindrical stem upstanding from said upper side thereof and having an upper end wall with an outlet port formed therein, said stem projecting from said lid member a sufficient distance for reception into the mouth of a person to permit drinking from the bottle by passage of the selected beverage through the outlet port, said protective cap comprising:

a generally cylindrical cap member having an upper closed end and a lower open end, said cap member having an inner diametric size for friction fit press-on engagement over said stem and a shape to fit matingly over said stem with a substantially zero clearance between said closed end of said cap member and said upper end wall of said stem;

a shoulder segment projecting generally radially outwardly from said cap member to overlie and engage said lid member at a position spaced radially outwardly from said stem;

tether means for flexibly interconnecting said cap member to said bottle; and pull ring means projecting generally upwardly from said cap member, whereby said cap member is manipulatable as a one-handed operation while holding said bottle body with the same hand to lift said cap member by pulling upwardly on said pull ring means so that said cap member is separated from said stem to permit drinking of the beverage within the bottle body, and further whereby said cap member is manipulatable as a one-handed operation while holding said bottle body with the same hand to mount said cap member into press-on engagement over said stem to close said outlet port and prevent passage of the beverage within the bottle body through said outlet port.

2. The combination of claim 1 wherein said cap member further includes a valve member for substantially snap-fit reception into said outlet port when said cap member is mounted in press-on engagement over said stem.

3. The combination of claim 1 wherein said bottle body is relatively nondeformable.

4. The combination of claim 1 wherein said bottle body is relatively squeezable.

5. The combination of claim 1 wherein said lid member has a vent hole formed therein, said shoulder segment overlying and fitting generally matingly over said lid member in the region of said vent hole with substantially zero clearance when said cap member is mounted in press-on engagement over said stem.

6. The combination of claim 1 wherein said stem has a radially enlarged flange formed generally at said upper end wall, said cap member defining an internal shape for mating and substantially snap-fit engagement with said flange when said cap member is mounted in press-on engagement over said stem.

7. The combination of claim 1 further including a drinking straw having an upper end and a lower end, at least one cutout formed in said straw generally at said straw lower end, and means for mounting said straw upper end to said lower side of said lid member whereby said straw and stem define a continuous flow path for dispensing of the beverage from within said bottle body to the exterior of the bottle through said outlet port in said stem.

8. The combination of claim 7 wherein said bottle body has a bottom wall, and said straw having a length to extend with said straw lower end disposed substantially against said bottom wall.

* * * * *